US006082581A

United States Patent [19]

Anderson et al.

[11] Patent Number: 6,082,581

[45] Date of Patent: Jul. 4, 2000

[54] BUSINESS CARD DISPENSER

[75] Inventors: Ross Anderson, 14712-94 Street, Edmonton, Alberta, Canada, T5E 3W5; Brian Conway, Edmonton, Canada

[73] Assignee: Ross Anderson, Edmonton, Canada

[21] Appl. No.: 09/067,445

[22] Filed: Apr. 28, 1998

[51] Int. Cl.[7] ..... B65H 1/08

[52] U.S. Cl. ..... 221/232; 221/259

[58] Field of Search ..... 221/232, 259, 221/268, 270, 251, 213; 206/39.4, 39.5

[56] References Cited

U.S. PATENT DOCUMENTS

| | | | |
|---|---|---|---|
| 3,308,989 | 3/1967 | Alltop et al. | 221/232 |
| 4,240,564 | 12/1980 | Pritchard . | |
| 5,069,333 | 12/1991 | Chen | 206/39.5 |
| 5,615,800 | 4/1997 | Meyers | 221/232 |
| 5,730,319 | 3/1998 | Gray et al. | 221/259 |

FOREIGN PATENT DOCUMENTS

| | | |
|---|---|---|
| 3430832 | 8/1984 | Germany . |
| 659941 | 4/1949 | United Kingdom . |
| 659373 | 10/1949 | United Kingdom . |
| 700698 | 3/1952 | United Kingdom . |
| 965871 | 2/1963 | United Kingdom . |
| 965871 | 8/1964 | United Kingdom . |
| 1154656 | 3/1967 | United Kingdom . |
| 2210603 | 6/1989 | United Kingdom . |
| 2210603 | 9/1998 | United Kingdom . |

*Primary Examiner*—Kenneth W. Noland
*Attorney, Agent, or Firm*—Davis and Bujold

[57] ABSTRACT

A business card dispenser includes a container having an interior cavity of a size that is just sufficient to accommodate a stack of business cards. A closure is provided on the container, whereby access is provided for the purpose of inserting the stack of business cards. A dispensing slot is provided through the container. A slider is manually movable toward and away from the dispensing slot. The slider has a depending gripping foot that engages an uppermost one of the business cards in the stack and moves said uppermost business card toward the dispensing slot. An inclined plane extends at a gradual upward slope from the bottom of the interior cavity to the dispensing slot to guide the uppermost card up the inclined plane to the dispensing slot, without regard to the number of cards remaining in the stack.

8 Claims, 4 Drawing Sheets

BUSINESS CARD DISPENSER

FIELD OF THE INVENTION

The present invention relates to business card dispenser and, more particularly, one that is hand held and can conveniently be stored in a pocket of one's clothing.

BACKGROUND OF THE INVENTION

Published U.K. Patent Application 2,210,603 which was filed in 1987 by Phillip Nigel Record discloses a pocket sized business card dispenser. The Record reference has a container with a removable closure through which a stack of business cards may be inserted. The container also has a dispensing slot through which individual business cards are ejected. In order to position a business card in alignment with the dispensing slot, without regard to how many business cards remain in the container, underlying springs are provided. The cards are ejected by means of a slider that is movable toward or away from the dispensing slot. The slider has an underlying foot that engages the uppermost business card. As the slider moves toward the dispensing slot the business card engaged by the underlying foot is pushed out of the dispensing slot. Similar teachings have been used in the past in dispensing of other things, such as razor blades and soap slabs.

Business card dispensers, such as disclosed by Record, have not come into general usage. It is believed that this is due to their size and, in particular, their thickness. Business card holders used by businessmen are approximately ¼ of an inch in thickness and generally hold 10–20 business cards. The business card holder constructed in accordance with the teachings of the Record reference are approximately ¾ of an inch in thickness. Unless business card dispensers can be made thinner to more closely resemble business card holders, they will not gain public acceptance.

SUMMARY OF THE INVENTION

What is required is a business card dispenser with a thinner profile.

According to the present invention there is provided a business card dispenser which includes a thin walled container having a top, a bottom, and an interior cavity. The interior cavity has a width dimension and a length dimension just sufficient to accommodate a width dimension and a length dimension of a business card. The inner thickness dimension between the top and the bottom within the interior cavity being just sufficient to accommodate a stack of business cards. A closure is provided on the container, whereby access is provided for the purpose of inserting the stack of business cards. A dispensing slot is provided through the container. A gripping foot is manually movable toward and away from the dispensing slot. Means is provided for manually moving the gripping foot. The gripping foot engages an uppermost one of the business cards in the stack. An inclined plane extends at a gradual upward slope from the bottom of the interior cavity to the dispensing slot. This enables an uppermost card on the stack to be guided up the inclined plane to the dispensing slot, without regard to the number of cards remaining in the stack.

By using an inclined plane as alignment means, instead of underlying springs; the business card dispenser, as described above, both the outer thickness dimension and the inner thickness dimension of the container can be reduced. The inner thickness dimension need only be just sufficient to accommodate a stack of business cards, as there are no springs or other feed mechanisms required. Normally between 10 and 20 business cards would be in the stack. The outer thickness dimension can be reduced to between ¼ and ½ of an inch, depending upon the number of business cards being accommodated.

Although beneficial results may be obtained through the use of the business card dispenser, as described above, the gripping foot utilized in the Record reference is viewed as being too bulky and unreliable. A more compact and reliable mechanism is required. Even more beneficial results may, therefore, be obtained when the gripping foot is supported by a knee spring oriented outwardly toward the dispensing slot and downwardly toward the bottom of the container. Upon movement of the slider away from the dispensing slot the knee spring flexes to allow the gripping foot to slide over the stack of business cards. Upon movement of the slider toward the dispensing slot the downward orientation of the knee spring causes the gripping foot to brace against the uppermost card on the stack of business cards.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
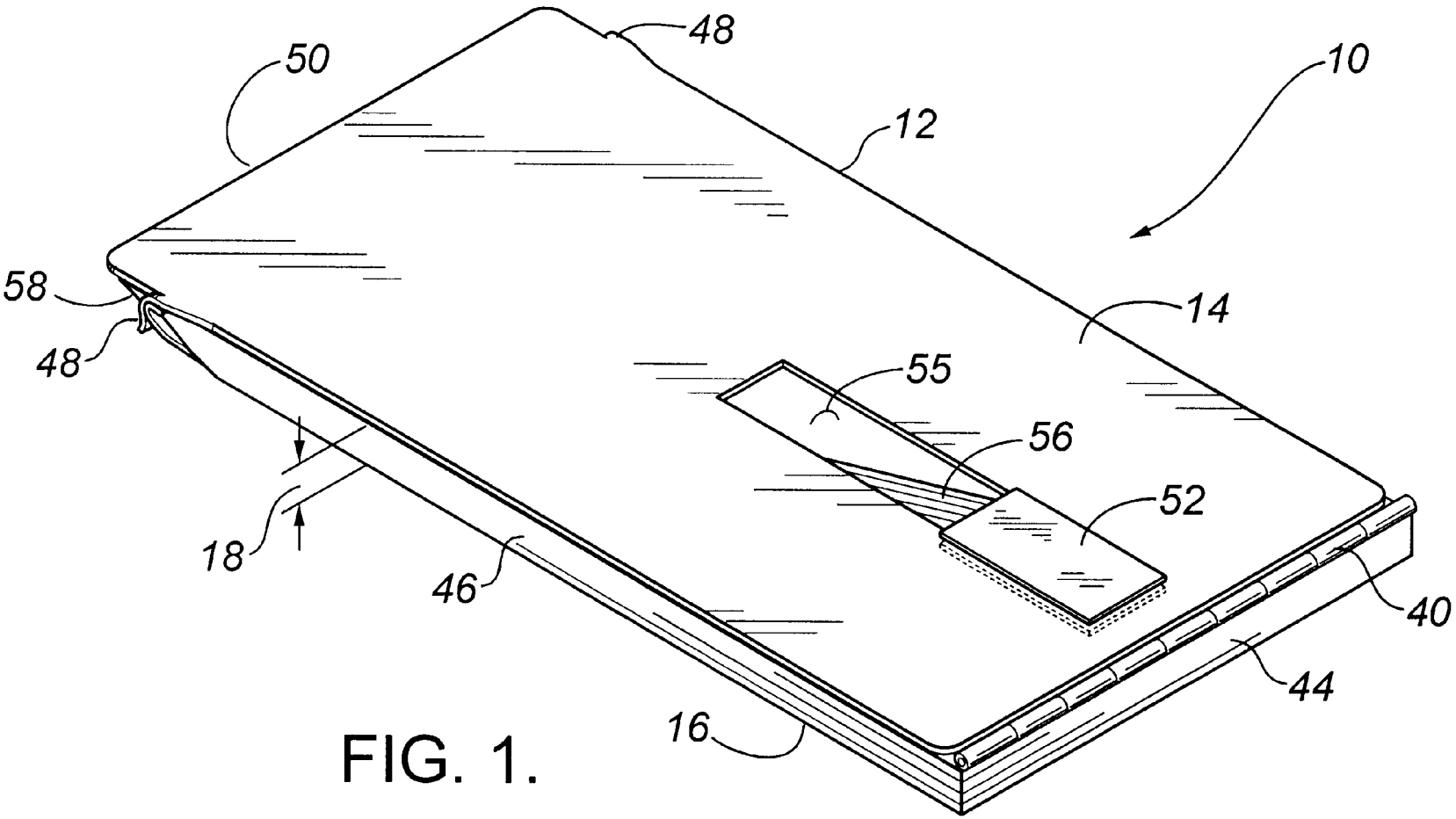
FIG. 1 is a perspective view of a business card dispenser constructed in accordance with the teachings of the present invention.

The preferred embodiment, a business card dispenser generally identified by reference numeral 10, will now be described with reference to FIGS. 1 through 5.

Figure 2:
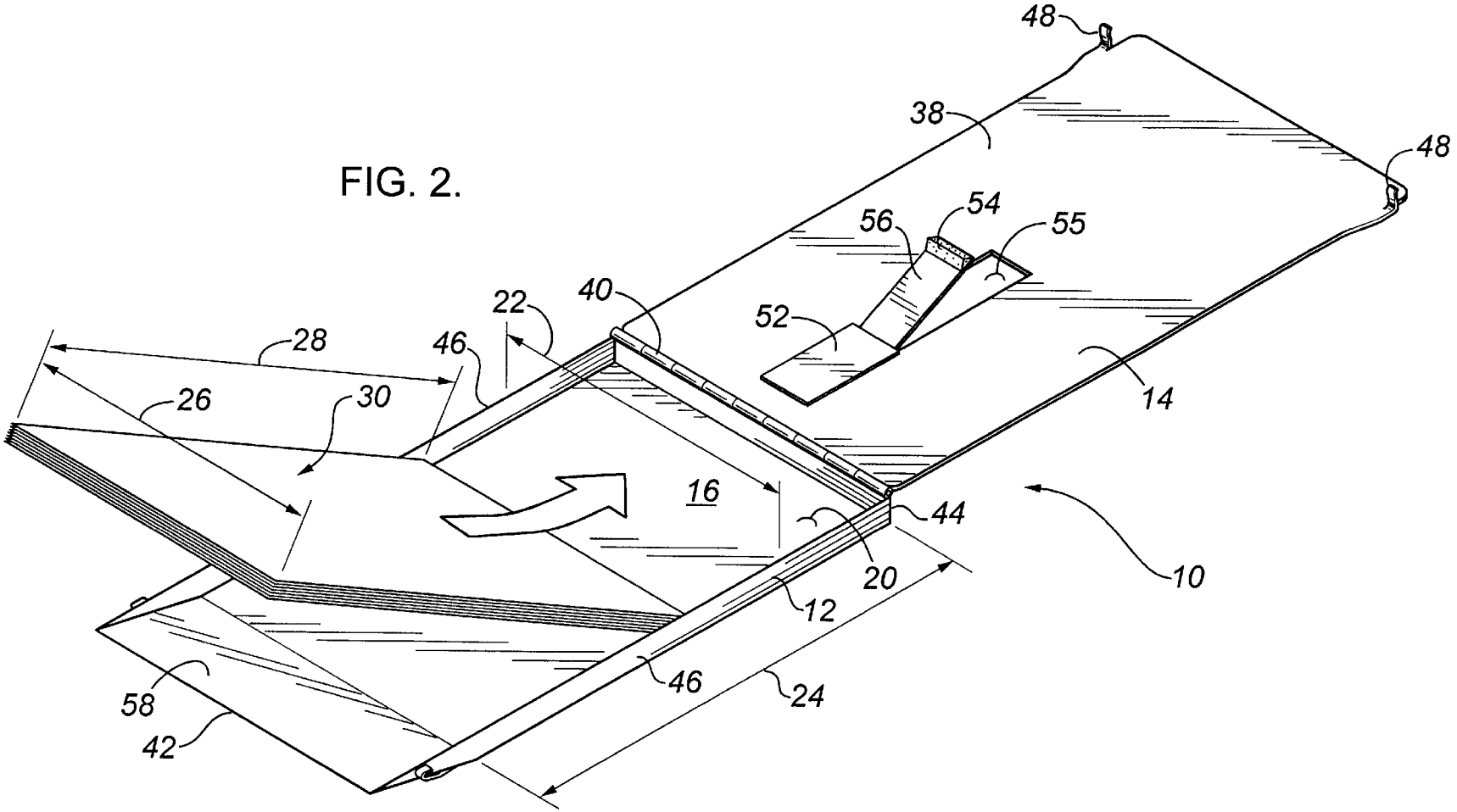
FIG. 2 is a perspective view of the business card dispenser illustrated in FIG. 1, with closure open to permit the insertion of a stack of business cards.
Figure 3:
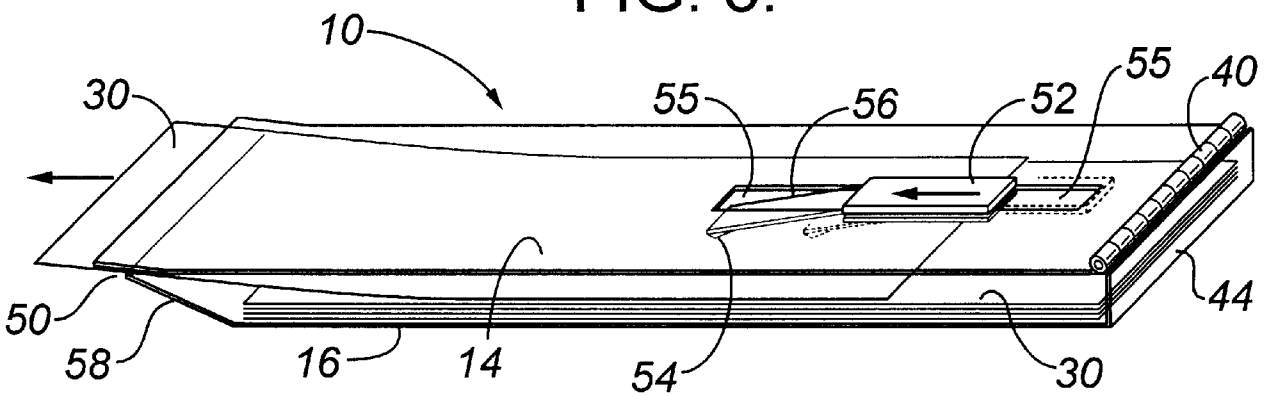
FIG. 3 is a cutaway side elevation view of the business card dispenser illustrated in FIG. 1.
Figure 4:
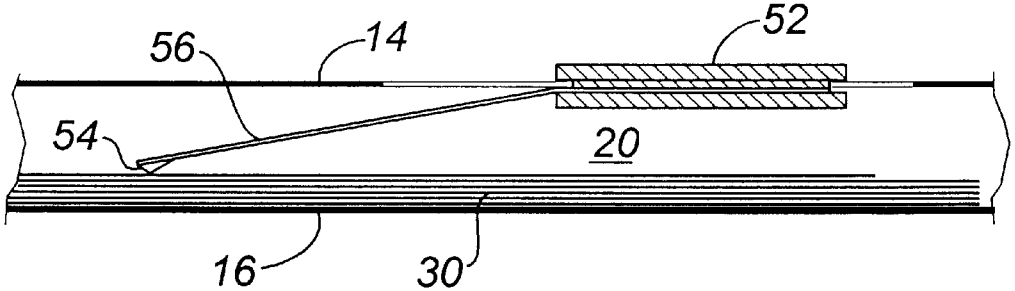
FIG. 4 is a detailed side elevation view of a slider and depending gripping foot portions of the business card dispenser illustrated in FIG. 1.
Figure 5:
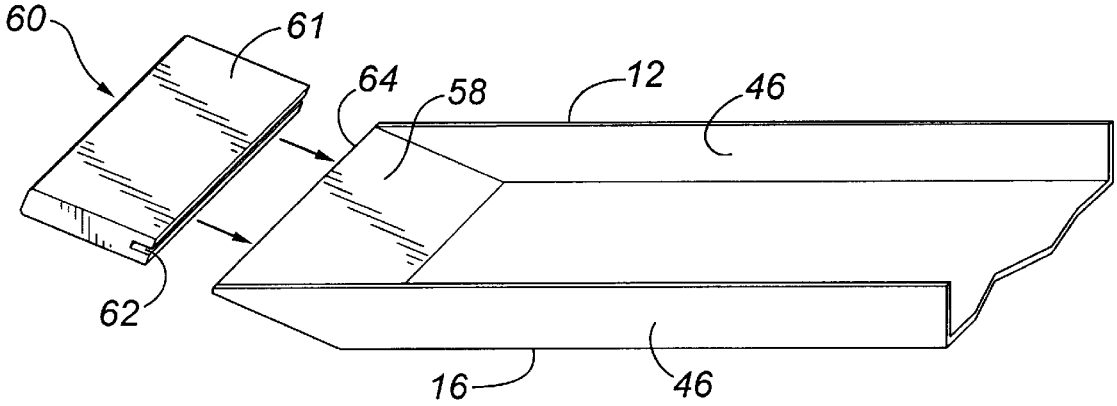
FIG. 5 is a perspective side view of the business card dispenser illustrated in FIG. 1, with a slot opening adjustment tool.

Referring to FIG. 1, business card dispenser 10 includes a thin walled container 12 having a top 14, a bottom 16 and an outer thickness dimension, indicated as 18, as measured between top 14 and bottom 16 of less then ½ of an inch. Outer thickness dimension 18 will be between ¼ of an inch and ½ of an inch depending upon the number of business cards to be accommodated as will hereinafter be further described. It is preferred that outer thickness dimension 18 be closer to ¼ of an inch. Referring to FIG. 2, container 12 has an interior cavity 20 with a width dimension, indicated as 22, and a length dimension, indicated as 24, just sufficient to accommodate a width dimension, indicated as 26, and a length dimension, indicated as 28, of a business card 30. Referring to FIG. 3, an inner thickness dimension between bottom 16 and top 14 within interior cavity 20 is just sufficient to accommodate a stack of between 10 and 20 business cards 30. It is preferred that the number be approximately 15 business cards 30. Referring to FIG. 2, a closure 38 is secured by a hinge 40 to container 12. In the illustrated embodiment, the entire top 14 serves as closure 38. Closure 38 permits access to interior cavity 20 for the purpose of inserting stack of business cards 30. Container 12 has a front 42, a back 44, and opposed sides 46. Hinge 40 is positioned along back 44. Friction clasps 48 depending from closure 38 engage sides 46 to maintain closure 38 in a closed position. Referring to FIGS. 1 and 3, a dispensing slot 50 is positioned at front 42 of container 12. Referring to FIG. 3, a thumb slider 52 is manually movable toward and away from dispensing slot 50. Referring to FIG. 4, slider 52 consists of two interconnected portions, one on either side of a slot 55 that extends through top 14. Referring to FIG. 3, slider 52 is wider than slot 55. Referring to FIG. 4, slider 52 has a depending spring biased gripping foot 54. Gripping foot 54 is supported by a spring 56. After experimenting with a variety of springs with mixed results, a dog leg shaped or knee shaped spring configuration was determined to provide advantages as will hereinafter be further described. Knee spring 56 is oriented outwardly toward dispensing slot 50 and downwardly toward bottom 16 of container 12. After experimenting with a variety of configurations of gripping foot 54 with mixed success, a solid rubber or elastomer wedge was determined to provide advantages as will hereinafter be further described. An inclined plane 58 extends at a gradual upward slope from bottom 16 within interior cavity 20 to dispensing slot 50. Business card dispenser 10 works best when dispensing slot 50 just barely provides sufficient room for business card 30 to pass through it. Business cards 30, however come in varying thicknesses. Referring to FIG. 5, a dispensing slot adjustment tool 60 is illustrated. Dispensing slot adjustment tool 60 has a body 61 with a longitudinally extending slot 62, that engages a lip 64 of dispensing slot 50.

The use and operation of business card dispenser 10 will now be described with reference to FIGS. 1 through 5. Referring to FIG. 2, closure 38 is opened to permit the insertion of the stack of business cards 30. Closure 38 is then closed to assume the position illustrated in FIG. 1. Referring to FIG. 3, in order to dispense one of business cards 30, slider 52 is moved using ones thumb. Upon movement of slider 52 away from dispensing slot 50, knee spring 56 flexes to allow gripping foot 54 to slide over stack of business cards 30. Upon movement of slider 52 toward dispensing slot 50, the knee spring 56 does not flex. Gripping foot 54 engages the uppermost one of business cards 30. The downward orientation of knee spring 56 results in knee spring 56 serving as a brace and working in combination with gripping foot 54 to push the uppermost card on stack of business cards 30 to move that card toward dispensing slot 50. As the stack of business cards 30 becomes depleted, aligning business card 30 with slot 50 can become a problem. In accordance with the present invention, however, business card 30 is guided from bottom 16 up inclined plane 58 to dispensing slot 50. This resolves the alignment problem, even when there is only one business card 30 remaining within interior cavity 20. Referring to FIG. 5, should it be necessary to adjust dispensing slot 50 to make it a better fit with business card 30, dispensing slot adjustment tool 60 is used. Longitudinally extending slot 62 is placed onto lip 64 of dispensing slot 50 and lip 64 is bent to adjust the width of dispensing slot 50 to better accommodate the thickness of business card 30. Lip 64 is unattached to container sides 46 in a cantilever fashion, allowing for easy adjustment.

For this application a special knee spring 56 had to be developed. With other spring configurations, every time the spring engaged one of the business cards 30 it was placed in a state of increased compression which resulted in stress on the spring. The stress on the spring lead to unacceptable premature spring failure. In contrast, when knee spring 56 is placed in a state of increased compression it actually has less stress placed upon it due to its shape. For example, a "V" shaped spring placed in compression is moved toward a more acutely bent position. The knee spring when placed in compression is moved toward a generally less bent position.

Gripping foot 54 must be capable of creating adequate card gripping friction when moving toward dispensing slot 50 and yet must release its grip to enable business card 30 to be pulled out through dispensing slot 50 and must slide away from dispensing slot 50 back over stack of business cards 30 easily. To meet these requirements the rubber wedged shaped configuration was developed for gripping foot 54. The thicker portion of the wedge is facing toward dispensing slot 50. When slider 52 is moved toward dispensing slot 50, knee spring 56 presses the thicker portion of the wedge of gripping foot 54 into business card 30. When someone pulls on business card 30, however, business card 30 tends to slide along the slope of the wedge of gripping foot 54 causing knee spring 56 to lift and release it's pressure rather than cause knee spring 56 to press gripping foot 54 more tightly into engagement with business card 30. Similarly, when slider 52 is moving away from dispensing slot 50, the slope of the wedge of gripping foot 54 tends to lift and release the pressure by knee spring 56, rather than cause knee spring 56 to more tightly press gripping foot into engagement with stack of business cards 30.

The combination of knee spring 56 and wedge shaped gripping foot 54 operates to maximize gripping force toward dispensing slot 50 while minimizing gripping force away from dispensing slot 50. If some means were not provided to release pressure upon gripping foot 54, rubber friction marks would be visible on the business cards 30 as they were dispensed and the rubber wedge of gripping foot 54 would rapidly become worn down through usage.

In the absence of the inclined plane 58 which lead to dispensing slot 50, there would continually be a problem of alignment of business card 30 being dispensed with dispensing slot 50 as stack of business cards 30 was diminished. Some other mechanical means of alignment would have to be used which would both increase the complexity of business card dispenser 10 and, of necessity, its depth.

It will be apparent to one skilled in the art that modifications may be made to the illustrated embodiment without departing from the spirit and scope of the invention as hereinafter defined in the claims.

What is claimed is:

1. A business card dispenser, comprising:

a thin walled container having a top, a bottom, and an interior cavity with a width dimension and a length dimension just sufficient to accommodate a width dimension and a length dimension of a business card, an inner thickness dimension between the top and the bottom within the interior cavity being just sufficient to accommodate a stack of business cards resting upon the bottom without an underlying spring:

a closure on the container whereby access is provided for the purpose of inserting the stack of business cards;

a dispensing slot being provided through a wall of the container;

a gripping foot manually movable toward and away from the dispensing slot, the gripping foot being arranged to engage an uppermost one of the business cards in the stack;

means for manually moving the gripping foot toward and away from the dispensing slot; and an inclined plane extending at a gradual upward slope from the bottom of the interior cavity to the dispensing slot such that as the gripping foot moves toward the dispensing slot the uppermost card is guided solely by the gradual upward slope of the inclined plane to the dispensing slot.

2. The business card dispenser as defined in claim 1, wherein the gripping foot is spring biased, away from the means for moving the gripper foot and toward the bottom of the container, to facilitate biasing the stack of business cards away from the top and toward the bottom of the container such that a lowermost business card directly engages against the bottom of the container.

3. A business card dispenser comprising:

a thin walled container having a top, a bottom, and an interior cavity with a width dimension and a length dimension just sufficient to accommodate a width dimension and a length dimension of a business card, an inner thickness dimension between the top and the bottom within the interior cavity being just sufficient to accommodate a stack of business cards;

a closure on the container for providing access to the interior cavity of the container for inserting the stack of business cards therein;

a dispensing slot provided in a surface of the container;

a gripping foot manually movable toward and away from the dispensing slot, the gripping foot being engageable with an uppermost business card from the stack of business cards;

a slider manually movable toward and away from the dispensing slot, the slider supporting the gripping foot;

an inclined plane extending at a gradual upward slope from the bottom of the interior cavity to the dispensing slot; and the gripping foot being supported by a knee spring from the slider, the knee spring being oriented outwardly toward the dispensing slot and downwardly toward the bottom of the container, such that upon movement of the slider away from the dispensing slot the knee spring flexes to allow the gripping foot to slide over the stack of business cards and upon movement of the slider toward the dispensing slot, the downward orientation of the knee spring causes the gripping foot to engage the uppermost card on the stack of business cards.

4. The business card dispenser as defined in claim 3, wherein the gripping foot is wedge shaped with the thicker end of the wedge shaped gripping foot is oriented toward the dispensing slot.

5. A business card dispenser including a thin walled container with a top, a bottom and an interior cavity having a width dimension and a length dimension just sufficient to accommodate a width dimension and a length dimension of a business card; an inner thickness dimension within the interior cavity between the bottom and the top just sufficient to accommodate a stack of between ten and twenty business cards; a closure on the container, providing access to the container to facilitate inserting a stack of business cards within the interior cavity; a dispensing slot provided in a surface of the container; a slider manually movable toward and away from the dispensing slot, the slider having a depending gripping foot, the gripping foot engaging an uppermost one of the business cards in the stack; and alignment means for aligning the uppermost one of the business cards with the dispensing slot, characterized by:

the alignment means comprises an inclined plane extending at a gradual upward slope from the bottom of the interior cavity to the dispensing slot, such that the uppermost card in the stack is guided along the inclined plane to the dispensing slot, without regard to the number of cards remaining in the stack; and the gripping foot being wedge shaped with the thicker end of the wedge shaped gripper foot being oriented toward the dispensing slot.

6. The business card dispenser as defined in claim 5, wherein the gripping foot being supported by a knee spring oriented outwardly toward the dispensing slot and downwardly toward the bottom of the container, such that upon movement of the slider away from the dispensing slot, the knee spring flexes to allow the gripping foot to slide over the stack of business cards and upon movement of the slider toward the dispensing slot, the downward orientation of the knee spring causes the gripping foot to engage the uppermost card on the stack of business cards.

7. A business card dispenser, comprising:

a thin walled container having a top, a bottom and an outer thickness dimension as measured between the top and the bottom of less then ½ of an inch, the container having an interior cavity with a width dimension and a length dimension just sufficient to accommodate a width dimension and a length dimension of a business card, the container having an inner thickness dimension within the interior cavity between the bottom and top just sufficient to accommodate a stack of approximately 15 business cards;

a closure on the container, whereby access is provided for the purpose of inserting the stack of business cards;

a dispensing slot through the container;

a slider manually movable toward and away from the dispensing slot, the slider having a depending wedge shaped gripping foot with a thick end of the wedge oriented toward the dispensing slot, the gripping foot being supported by a knee spring oriented outwardly toward the dispensing slot and downwardly toward the bottom of the container, such that upon movement of the slider away from the dispensing slot the slope of the wedge shaped gripping foot lifts the knee spring causing the knee spring to flex sufficiently to allow the gripping foot to slide over the stack of business cards and upon movement of the slider toward the dispensing slot the downward orientation of the knee spring causes the wedge shaped gripping foot to engage an uppermost card on the stack of business cards; and an inclined plane extending at a gradual upward slope from the bottom of the interior cavity to the dispensing slot, such that the uppermost card on the stack is guided up the inclined plane to the dispensing slot, without regard to the number of cards remaining in the stack.

8. In combination:

a business card dispenser, comprising:

a thin walled container having a top, a bottom, and an interior cavity with a width dimension and a length dimension just sufficient to accommodate a width dimension and a length dimension of a business card, an inner thickness dimension between the top and the bottom within the interior cavity being just sufficient to accommodate a stack of business cards;

a closure on the container, whereby access is provided for the purpose of inserting the stack of business cards;

a dispensing slot through the container having at least one lip which is secured in a cantilevered fashion to the container;

a slider manually movable toward and away from the dispensing slot, the slider having a depending gripping foot, the gripping foot, being spring biased into engagement with an uppermost one of the business cards in the stack; and an inclined plane extending at a gradual upward slope from the bottom of the interior cavity to the dispensing slot, such that the uppermost card is guided up the inclined plane to the dispensing slot, without regard to the number of cards remaining in the stack; and a dispensing slot adjustment tool having a body with a longitudinally extending slot, the longitudinally extending slot engaging the lip of the dispensing slot, thereby permitting the lip to be bent to wider or narrow the dispensing slot.

* * * * *